United States Patent [19]

Mathey

[11] 4,243,446

[45] Jan. 6, 1981

[54] METHOD OF MAKING A LUFFA COMPOSITE

[75] Inventor: Jean M. Mathey, Saint Rambert d'Albon, France

[73] Assignee: Allibert Exploitation, Societe Anonyme, Grenoble, France

[21] Appl. No.: 967,851

[22] Filed: Dec. 8, 1978

[30] Foreign Application Priority Data

Dec. 14, 1977 [FR] France ..... 77 38538

[51] Int. Cl.[3] ..... B32B 17/00; A43B 13/38; D01B 1/10; D01B 3/04

[52] U.S. Cl. ..... 156/62.4; 156/148; 36/43; 19/7; 19/66 R

[58] Field of Search ..... 156/62.2, 62.4, 148, 156/257; 36/43; 241/15; 28/107; 19/66 R, 1, 7

[56] References Cited

U.S. PATENT DOCUMENTS

| | | | |
|---|---|---|---|
| 1,814,155 | 7/1931 | Haughey | 19/7 |
| 2,331,321 | 10/1943 | Heaton | 156/62.2 |
| 2,592,747 | 4/1952 | Schumann | 156/257 |
| 3,284,872 | 11/1966 | Closson, Jr. | 156/148 |

OTHER PUBLICATIONS

Ozite, Am. Shoemaking, Nov. 22, 1950, p. 4.

*Primary Examiner*—John T. Goolkasian
*Assistant Examiner*—Louis Falasco
*Attorney, Agent, or Firm*—Karl F. Ross

[57] ABSTRACT

Luffas are subject to disintegration into fibers which are carded and needled to a textile support. The resulting product is impregnated with a synthetic resin, dried and calendared to produce a foil from which, for example, inner soles can be cut or stamped.

8 Claims, 3 Drawing Figures

METHOD OF MAKING A LUFFA COMPOSITE

FIELD OF THE INVENTION

The present invention relates to a method of making a luffa composite material and, more particularly, to a process for treating luffas and especially the cellulose interiors thereof in order to obtain a new and useful composite material. The invention also relates to the product thus produced, articles of manufacture made therefrom, a process for making such articles and an apparatus for carrying out the process.

BACKGROUND OF THE INVENTION

Luffas are sponges which are of diverse origin, especially Chinese, Korean and Brazilian, which comprises a cellular inner skeleton or body (interior) constituted of fibrous material having absorbent properties which have been found to be especially valuable in the fabrication of inner soles for footwear of various types.

In order to facilitate an understanding of the invention reference will be made from time to time herein to such articles. However, inner soles are merely a preferred product of the invention and the best mode currently known for practicing it. Naturally other products and articles can be made in accordance with the same principles and the invention is not to be considered to be limited to the production of inner soles except insofar as the production thereof may be specifically claimed. In other words, the application to inner soles is an art-limiting example of the principles of the invention.

In the production of luffa inner soles it has been a perennial problem to obtain luffas of sufficient size to permit the inner soles to be cut therefrom, particularly where the articles themselves are comparatively large. Such luffas usually come from China and the availability is irregular. Independently of the fact that large size luffas are increasingly a rarity and difficult to obtain, the cost is so high as to preclude their economical use in the production of absorbent inner soles. Nowadays, at least, only a pair of inner soles at best can be made from each luffa. Scraps are significant.

OBJECTS OF THE INVENTION

It is the principal object of the present invention to provide an improved method of fabricating a luffa composite wherein the disadvantages of earlier methods of using luffas can be avoided.

Another object of the invention is to provide a method of making articles which require high absorbency at relatively low cost and with excellent properties.

A further object is to provide an improved material or product which has high absorbency and low cost.

It is also an object of the invention to provide an apparatus for carrying out the improved methods or processes.

SUMMARY OF THE INVENTION

The invention is directed to overcoming the difficulties hitherto encountered in obtaining luffas of good quality and large size and permitting the utilization of luffas from any sort and any size. According to the invention, therefore, a process is provided which reconstitutes, starting form luffas or scraps thereof obtained in the cutting of soles therefrom, of a material which has the form of a foil of large dimensions and which, in turn, can be cut into inner soles of all sizes and of the high absorbency characterizing the soles cut from luffas directly. The invention thus economically provides not only inner soles and like articles of high absorbency, but, generally, any new articles from a material which is, in its properties, identical to the corresponding articles formed directly from the interior skeleton of luffas; the process permits use of luffas of any source of size.

According to the invention, the luffas are disintegrated i.e. the porous, fibrous skeleton or interior of the luffas are mechanically broken down into fibers and the fibers which result from this disintegration are carded. The carded fibers are needled onto a textile support and the resulting product is impregnated with a synthetic resin, dried and calendared.

The ultimate product is a foil which can be used in the fabrication of various articles, especially inner soles, which can be cut by stamping or other means from this foil.

The various steps generally referred to above and their sequence and their relationship to other steps characterize the invention.

In the first phase or step of the invention, the interiors or skeletons of the luffa sponges of any origin or scraps of such interiors are disintegrated. The disintegration is carried out such that the skeleton itself is destroyed without damage to the fibers constituting the skeleton. It has been found that destruction of the fibers will occur if the mechanical abrading or tearing of the skeleton is not preceded by an oiling or lubrication of the interior.

The lubrication step is carried out by finely dispersing on the interior of the luffas or their scraps, preferably by an atomizing spray and most advantageously by means of a spray gun, water to which is added a small proportion of an oil which plays the role of a lubricant. Practically any oil can be used for this purpose and preference is given to the lubricant marketed under the name PERMOL. The atomizing spray is preferably applied to the luffas in a recumbent position, the spray containing from 0.01 to 5% by weight of the lubricant, the balance being water and/or a surface active agent of the type used in textile treatment as a wetting agent. The lubricant solution, which can consist of the water and the oil, should be applied in an amount of about 10% by weight of the luffas treated.

The luffas are found to absorb a small quantity of water relative to their absorbent power, the moisture and the oil promoting the disintegration without damage to the fibers.

During the disintegration, the fibers of other types can be introduced if desired.

The fibers of other materials can also be added subsequent to the disintegration.

The added fibers should have at least two properties as detailed below. Firstly, they should be hydrophilic and secondly they should be much lighter than the luffa fibers.

These additional fibers which do not contribute to any material reduction in the absorbtive capacity of the final product have been found to play a significant role since they aerve as a sublayer upon which the luffa fibers can be deposited by the steps described below.

Various fibers can be used to this end although it is advantageous to employ fibers of a fibranne-viscose, i.e. spun viscose fibers of 8 to 20 Btex. The quantity of fibers used of the viscose, by comparison to the total fiber mixture, is 5 to 10% by weight.

The mixture of fibers thus obtained is then subjected to carding. In other words, the carded product is the mixture of the viscose and luffa fibers.

The carding which is carried out in accordance with the present invention is a pneumatic carding under special conditions such that the luffa fibers and the viscose fibers separate and form two layers, the first disposed above the other. Thus the pneumatic carding or air-carding operation deposits first a sublayer of the viscose fibers and next a layer of the luffa fibers thereon. The presence of the additional fibers greatly facilitates this integration when the viscose fibers are added prior to disintegration and also has been found to facilitate the air-carding operation.

The pneumatic carding operation also permits the difference in density to be used to form the sublayer of the fibranne-viscose fibers below that of the luffa fibers which are projected by the air-carding machine further than the viscose fibers.

The viscose fibers thus form a thin pile upon the transport belt and the ultimate fabric to which the fibers are to be needled while the luffa fibers then are deposited in a substantially thicker layer. In the absence of the sublayer of viscose fibers, the luffa fibers are found not to have a sufficient coherence to permit their uniform displacement.

Because of this specific carding operation, the complex cushion of fibers is able to be needled without difficulty onto a nonwoven textile support which is preferably constituted by a polyester or viscose material.

The needled product thus obtained is then impregnated by immersion in a bath and the impregnated foil is then squeezed to eliminate excess liquid. The impregnating bath, according to an important feature of the invention, simultaneously contains both a thermoplastic resin and a thermosetting resin.

It should be observed that the simple immersion impregnation of the needled layer by passage through a bath is not applicable in the case in which the final foil is to be supplied in a rough or semifinished state. This may be desirable where the foil is to be cut into soles which are then sandwiched between covers of thin fabric or where a thin fabric layer is to be applied to the soles. This fabric coverings of this type are used for soles destined primarily for summer wear.

Where soles primarily for winter wear are to the made, the two faces of the foil are covered by relatively thick fabric. It is possible to bond the cushion of fibers with one of the cover fabrics during the needling operation in which case impregnation is not desired by immersion in a bath because it tends to limit the permeability of the covering fabric. In this case, impregnation by the inverse technique can be used with the impregnating solution being applied by coating or printing onto the exposed surface of the fiber layer.

Whatever the method of impregnation, the impregnating bath can include various additives which render the end product more stable or more sanitary. For example, the additives may be fungicides, microbicides, deoderants or chemicals desired for foot care.

After impregnation, the fibers are dried and calendared.

The drying is advantageously carried out in a perforated-drum type tumbler under vacuum or suction at a temperature sufficient to cause cross linking or setting of the resin. The calendaring is effected under pressure and a temperature of the order of 150° C.

Because of the sequence of steps described above, the invention yields an entirely new product which is essentially a foil of luffa fibers of a character not unlike the natural interiors of the luffa sponges. It is highly hydrophilic and this can be used most effectively in the production of inner soles.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figures 1, 2, 3:
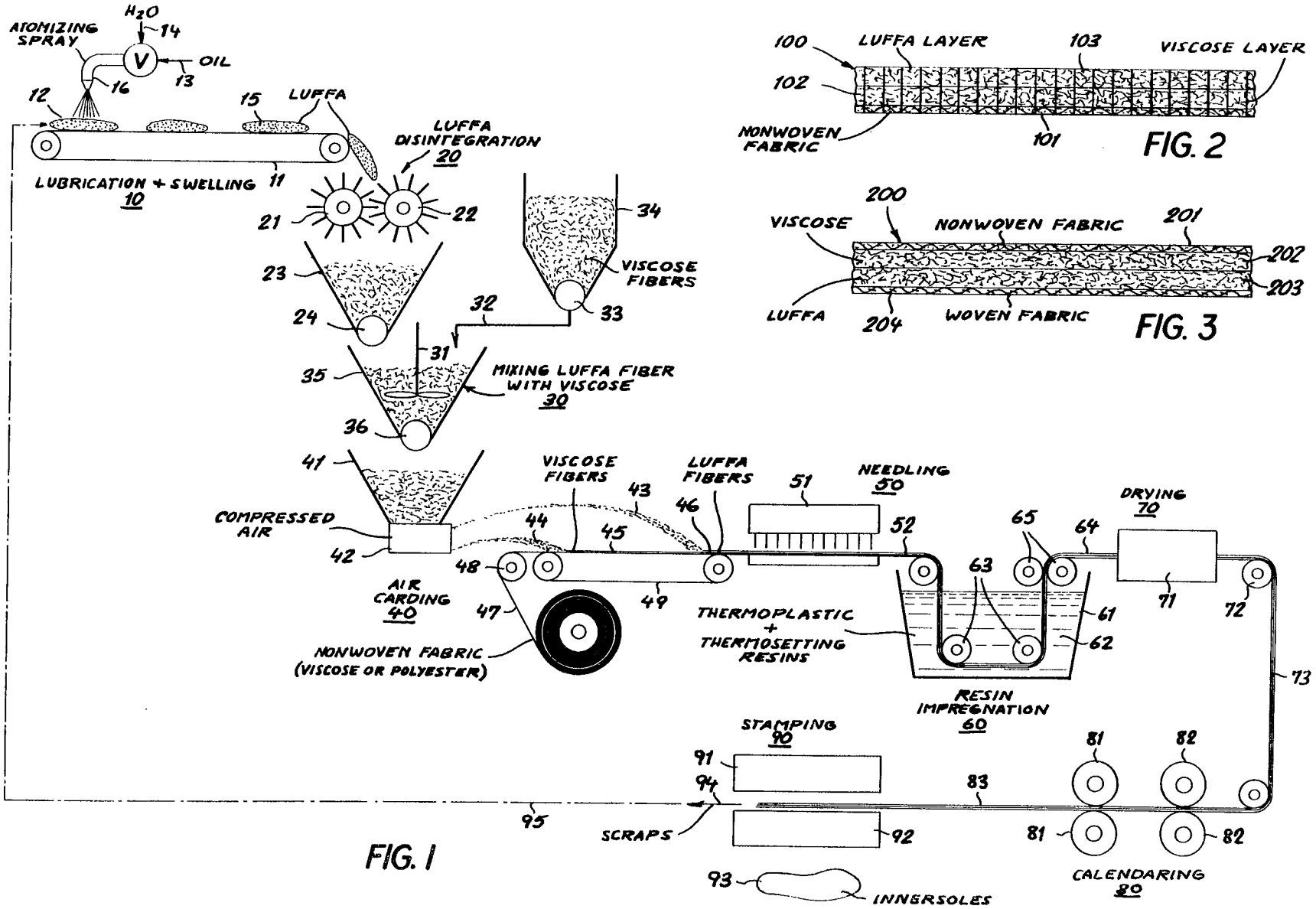
FIG. 1 is a flow diagram illustrating aspects of the invention.
FIG. 2 is a diagrammatic cross-sectional view through a product made in accordance with the present invention.
FIG. 3 is a view similar to FIG. 2 of another such product.

The apparatus shown in FIG. 1 comprises a lubrication and swelling station 10 which is followed by a luffa-disintegration station 20. The luffa fibers are mixed with the viscose fibers at 30 and the fiber mixture is subjected to air carding at 40. The layers are applied to a nonwoven fabric and are needled thereto at 50, the needled composite being subjected to resin impregnation at 60, drying at 70 and calendaring at 80. Inner soles may be stamped from the product foil at 90 and scraps may be returned to the inital stage as represented at 95, if desired.

More particularly, the lubricating and swelling stage 10 makes use of an endless conveyor 11 upon which the luffa sponges 12 are deposited in a recumbent position. The luffa sponges are passed beneath an atomizing spray from a spray gun 16. A valve controls the proportions of water and oil fed to the spray gun as represented at 14 and 13, respectively. The oil/water spray impregnates the luffa sponges and a moisturized and lubricated luffa sponge is shown at 15 about to be deposited between the disintegrating drums 21 and 22 of the disintegrating station 20.

The disintegrating station may make use of drums formed with pins as diagrammatically shown, the practically undamaged fibers being collected in a hopper 23 and being metered at 24 into a hopper 35. In the hopper 35 the luffa fibers are mixed with viscose fiber delivered from a hopper 34 via a metering device 33 and a conveyor represented at 32. The mixing means is shown only diagrammatically as a stirrer 31.

The luffa fiber/viscose fiber mixture is then fed by the metering device 36 into a hopper 41 of the air-carding machine 42 to which compressed air is supplied.

As has been shown diagrammatically in the drawing, the air-carding machine 42 projects a first stream 44 of viscose fibers and a second stream 43 of the luffa fibers on to a nonwoven fabric bed 47 supplied from a roll over a roller 48 on to a conveyor belt or blanket 49 conveying the layers 45 and 46, respectively of the viscose fibers and luffa fibers, from the air-carding station 40 to the needling station 50.

The needling machine can be conventional in the art and has been shown only diagrammatically at 51. At the needling station 50, the needling machine 51 needles the luffa fibers to the viscose fibers and both layers of fibers to the underlying nonwoven fabric 47.

The needled web 52 is thereupon passed into a bath 62 of thermoplastic and thermosetting resins in a basin 61 beneath, for example, the rollers 63 which ensure immersion of the web.

The impregnated web is squeezed between rollers 65 and passes at 64 into the drying station 71. In the drying station, if the web is continuous, it can pass over and under perforated drums which are evacuated and by means of which the impregnated web is subjected to the drying temperature. Alternatively, the webs can be treated in lengths by tumbling.

The dried impregnated web is passed at 73 via rollers 72, into the calendaring station 80, the web being passed at an elevated temperature through the nips of rollers 81 and 82. The calendared foil is represented at 83 and is subjected to stamping at 90 between the stamping dies 91 and 92 to produce the inner soles 93. The scraps are passed out of the stamping machine as shown at 94.

FIGS. 2 and 3 show embodiments of the foil prior to impregnation. In the embodiment illustrated in FIG. 2, the luffa layer 103 is shown to overlie the viscose layer 102 which, in turn, overlies the nonwoven fabric layer 101, the entire composite being needled together as illustrated diagrammatically. The resulting product can be provided with cover fabrics with or without impregnation by any conventional bonding technique but preferably is impregnated as shown at 60 and then calendared etc. in the manner previously described. In the embodiment of FIG. 3, however, the nonwoven fabric layer 201 overlies the viscose layer 202 and the luffa layer 203 while a woven fabric is applied to the free surface of the luffa layer as shown at 204 after the free surface of the luffa layer has been coated with the resin by the inverse coating technique.

SPECIFIC EXAMPLE

A foil is fabricated in the manner described in FIG. 1 for use as inner soles and consists of 400 g/m$^2$ of luffa fibers, 40 g/m$^2$ of fibranne-viscose fibers, 250 g/m$^2$ of the nonwoven polyester textile support and 100 g/m$^2$ of the impregnating resin.

The lubrication and swelling steps (station 10 in FIG. 1) is carried out using a lubicant solution which is applied in an amount of 10% by weight of the luffa sponges. The lubricating solution consists of 0.5% by weight of PERMOL* and 99.5% by weight water. The lubrication step is carried out at room temperature.

*Water emulsifiable mineral oil sold in France by SOPROSOIE

After disintegration, the average length of the luffa fibers is 20 to 30 mm while the viscose fibers have a length of 60 mm. The mixture is constituted by 90% luffa fibers and 10% viscose fibers by weight.

The nonwoven fabric support 47 is a polyester having a density of 250 g/m$^2$. The needling step is carried out with 60 to 70 needlings/cm$^2$.

The impregnating solution is constituted by 50% by weight DL 815,* 33% by weight PROX M3** and 17% by weight water. Drying is carried out at 140° C. with the application of suction and the thickness of the impregnated drive foil prior to calendaring is 4 to 4.5 mm and after calendaring is 2.5 to 3 mm. The foil is found to have excellent absorbency and to be no different is cushioning effect and insulating effect from luffa sponge inner soles cut directly from the luffa sponges. While Chinese, Korean and Brazilian luffa sponges were all used in the process of the present invention, material differences could not be discerned between them.

*Butadiene-styrene latex (DOW CHEMICAL)

**Melamine-formaldehyde thermosetting resin (PROTEX, FRANCE)

While the preferred and best mode of the invention is the specific example given above for the production of inner soles, it is important to note again that the field of application of the invention is not limited to inner soles for footwear. It can be used to produce all products hitherto made from luffa and which can be made from the reconstituted luffa foil. It can be used effectively in cushions for furniture and automotive vehicle seats and the like.

I claim:

1. A method of forming a composite material of high absorbency and cushioning effect, comprising the steps of:

(a) disintegrating luffa sponges to form fibers therefrom;

(b) carding the fibers resulting from step (a);

(c) needling said fibers to a textile support of a nonwoven fabric to form a web;

(d) impregnating the needled web produced in step (c) with a mixture of thermoplastic and thermosetting synthetic resins;

(e) drying the resin-impregnated web formed in step (d); and (f) calendaring the dried impregnated web to form a foil, the luffas being lubricated with an aqueous solution containing a lubricant prior to disintegration such that the fibers of the luffas prior to its disintegration absorb between 5 and 15% of their weight of water to at least partially swell the fibers, the luffa fibers formed by disintegration being mixed with substantially lighter fibers and the fiber mixture being carded in step (b).

2. The method defined in claim 1, further comprising the step of:

(g) cutting inner soles from said foil.

3. The method defined in claim 1 wherein the impregnation is carried out by immersing the web in a bath of the synthetic resin.

4. The method defined in claim 1 wherein said web is impregnated with said resin by inverse coating and a fabric layer is applied to said web.

5. The method defined in claim 1 wherein the carding is carried out by air carding with deposition of the lighter fibers on said textile support and the loofah fibers on the lighter fibers.

6. The method defined in claim 1 wherein the lighter fibers are viscose fibers.

7. The method defined in claim 1 wherein the fiber mixture contains about 90% luffa fibers and 10% viscose fibers, the needling density is about 50 to 70 needles/cm$^2$ and the impregnated web prior to calendaring has a thickness of 4 to 4.5 mm and after calendaring between 2.5 and 3 mm.

8. A web reconstituted from luffa fibers and made by the method of claim 1, claim 2, claim 3, claim 4, claim 5, claim 6 or claim 7.

* * * * *